US006525704B1

(12) United States Patent
Kondo et al.

(10) Patent No.: US 6,525,704 B1
(45) Date of Patent: Feb. 25, 2003

(54) IMAGE DISPLAY DEVICE TO CONTROL CONDUCTION TO EXTEND THE LIFE OF ORGANIC EL ELEMENTS

(75) Inventors: Yuji Kondo, Tokyo (JP); Atsushi Kota, Tokyo (JP)

(73) Assignee: NEC Corporation, Tokyo (JP)

( * ) Notice: Subject to any disclaimer, the term of this patent is extended or adjusted under 35 U.S.C. 154(b) by 273 days.

(21) Appl. No.: 09/589,283

(22) Filed: Jun. 8, 2000

(30) Foreign Application Priority Data

Jun. 9, 1999 (JP) ..... 11-162422

(51) Int. Cl.[7] ..... G09G 3/30; G09G 3/10

(52) U.S. Cl. ..... 345/78; 315/169.3

(58) Field of Search ..... 345/36, 45, 76, 345/77, 78, 79, 80, 211, 212, 214, 215, 52–54; 315/169.3; 340/825.81

(56) References Cited

U.S. PATENT DOCUMENTS 5,079,483 A * 1/1992 Sato ..... 315/169.3
5,576,726 A * 11/1996 Rhyne et al. ..... 345/76
5,652,600 A * 7/1997 Khormaei et al. ..... 345/76
5,670,792 A * 9/1997 Utsugi et al. ..... 257/59
5,714,968 A * 2/1998 Ikeda ..... 345/77
5,940,053 A * 8/1999 Ikeda ..... 345/77
6,011,529 A * 1/2000 Ikeda ..... 345/77
6,091,203 A * 7/2000 Kawashima et al. ..... 315/169.3
6,175,345 B1 * 1/2001 Kuribayashi et al. ..... 345/76
6,188,375 B1 * 2/2001 Kagey ..... 345/76
6,246,384 B1 * 6/2001 Sano ..... 345/76
6,278,423 B1 * 8/2001 Wald et al. ..... 345/76

FOREIGN PATENT DOCUMENTS

JP A 11-95723 4/1999

* cited by examiner

*Primary Examiner*—Bipin Shalwala
*Assistant Examiner*—Jeff Piziali
(74) *Attorney, Agent, or Firm*—Young & Thompson

(57) ABSTRACT

An image display device applies (M×N) data voltages in order to M rows of data lines N voltages at a time, and in synchronization with these data voltages, applies scan voltage in order to the N columns of scan lines. This scan voltage causes M rows and N columns of switching elements to turn on one column at a time, and accordingly, (M×N) data voltages that are applied from the M rows of data lines are individually held by M rows and N columns of voltage holding means. In accordance with these held voltages, M rows and N columns of drive transistors apply a drive voltage that is constantly applied to power supply electrodes to (M×N) organic EL elements. The M rows and N columns of organic EL elements are accordingly actively driven and a multiple gray-scale dot matrix image is displayed. However, conduction control elements halt the application of the drive voltage to the M organic EL elements of the nth column immediately before the scan voltage is applied to the scan line of the nth column. As a result, conduction to the organic EL elements is halted instantaneously even when an image of the same luminance is continuously displayed, thereby extending the life of the organic EL elements.

17 Claims, 13 Drawing Sheets

SCAN LINE n-1
5V
0

SCAN LINE n
5V
0

CONTROL TFT Gate
5V
0

SWITCHING TFT Gate
5V
0

DRIVE TFT Gate
5V
0

CAPACITOR
5V
0

ORGANIC EL ELEMENT
7~10V
0

SCAN LINE n-1
5V
0

SCAN LINE n
5V
0

1ST CONTROL TFT Gate
5V
0

SWITCHING TFT Gate
5V
0

DRIVE TFT Gate
5V
0

2ND CONTROL TFT Gate
5V
0

CAPACITOR
5V
0

ORGANIC EL ELEMENT
7~10V
0

Fig.10a SCAN LINE n-1
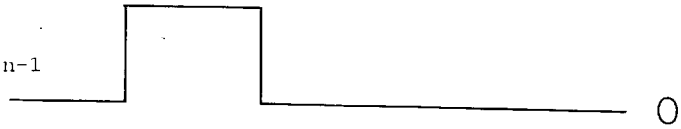
Fig.10b SCAN LINE n
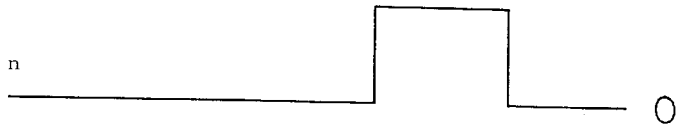
Fig.10c EL ELEMENT
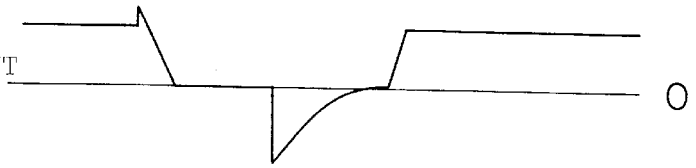
Fig.11
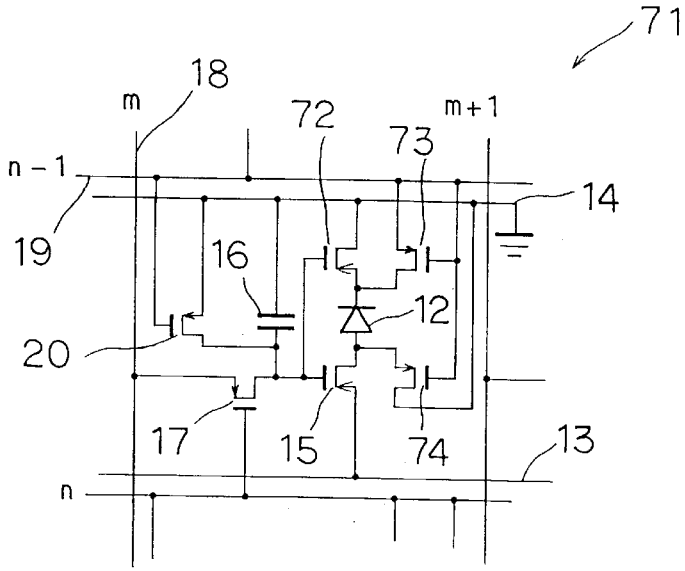

SCAN LINE n-1
5V
0

SCAN LINE n
5V
0

1ST CONTROL TFT Gate
5V
0

SWITCHING TFT Gate
5V
0

3RD CONTROL TFT Gate
5V
0

DRIVE TFT Gate
5V
0

4TH CONTROL TFT Gate
5V
0

5TH CONTROL TFT Gate
5V
0

CAPACITOR
5V
0

ORGANIC EL ELEMENT
7~10V
0
-5V

SCAN LINE n-2
5V
0

SCAN LINE n-1
5V
0

SCAN LINE n
5V
0

1ST CONTROL TFT
Gate
5V
0

SWITCHING TFT
Gate
5V
0

3RD CONTROL TFT
Gate
5V
0

DRIVE TFT
Gate
5V
0

4TH CONTROL TFT
Gate
5V
0

5TH CONTROL TFT
Gate
5V
0

CAPACITOR
5V
0

ORGANIC EL ELEMENT
7~10V
0
-5V

IMAGE DISPLAY DEVICE TO CONTROL CONDUCTION TO EXTEND THE LIFE OF ORGANIC EL ELEMENTS

BACKGROUND OF THE INVENTION

1. Field of the Invention

The present invention relates to an image display device for displaying an image, and more particularly to an image display device that displays an image by actively driving a multiplicity of two-dimensionally arranged organic EL (Electro-Luminescent) elements.

2. Description of the Related Art

EL displays for displaying a dot matrix image in which a multiplicity of organic EL elements are two-dimensionally arranged have currently been developed as image display devices for displaying various images in locations subject to radical changes in illumination, such as the interior of an automobile. Organic EL elements are light-emitting elements that spontaneously emit light and can be driven by a low-voltage direct current.

Methods of driving organic EL elements include passive matrix drive methods and active matrix drive methods. An active matrix drive method can achieve high luminance with high efficiency because the organic EL elements are lit continuously until updating of the display image.

As an example of an image display device of the prior art, explanation is presented with reference to FIG. 1 and FIG. 2 regarding an EL display that actively drives organic EL elements.

As shown in FIG. 1, EL display 1 that is presented as an example of the prior art includes organic EL element 2 as well as power supply line 3 and ground line 4 as a pair of power supply electrodes. A predetermined drive voltage is constantly applied to power supply line 3, and ground line 4 is constantly maintained at 0 V, which is the reference voltage.

Organic EL element 2 is directly connected to ground line 4 but is connected to power supply line 3 by way of drive TFT (Thin-Film Transistor) 5. This drive TFT 5 includes a gate electrode, and the drive voltage that is applied to ground line 4 from power supply line 3 is supplied to organic EL element 2 according to a data voltage that is applied to this gate electrode.

One end of capacitor 6 is connected to the gate electrode of drive TFT 5, and the other end of this capacitor 6 is connected to ground line 4.

Data line 8 is connected to this capacitor 6 and the gate electrode of drive TFT 5 by way of switching TFT 7, which is a switching element, and scan line 9 is connected to the gate electrode of this switching TFT 7.

A data voltage for driving the light emission intensity of organic EL element 2 is supplied to data line 8, and a scan voltage for controlling switching TFT 7 is applied to scan line 9. Capacitor 6 holds the data voltage and applies it to the gate electrode of drive TFT 5, and switching TFT 7 turns the connection between capacitor 6 and data line 8 ON and OFF.

In EL display 1, (M×N, M and N are predetermined natural numbers) organic EL elements 2 are arranged two-dimensionally in M rows and N columns (not shown in the figures), and M rows of data lines 8 and N columns of scan lines 9 are connected in a matrix to these M rows and N columns of organic EL elements 2. In the figures, the term "row" refers to the dimension parallel to the vertical direction and the term "column" refers to the dimension parallel to the horizontal direction, but this is merely a matter of definition, and the reverse case is also possible.

EL display 1 according to the above-described construction is capable of driving organic EL elements 2 with variable light emission intensity. In such a case, a scan voltage is applied to scan line 9 and switching TFT 7 is controlled to an ON state as shown in FIG. 2*b* and FIG. 2*c*, and a data voltage from the data line that corresponds to the light emission intensity of organic EL element 2 in this state is supplied to and held in capacitor 6 as shown in FIG. 2*e*.

The data voltage held by this capacitor 6 is applied to the gate electrode of drive TFT 5 as shown in FIG. 2*d*, and as a result, as shown in FIG. 2*f*, the drive voltage that is constantly generated at power supply line 3 and ground line 4 is supplied to organic EL element 2 by drive TFT 5 in accordance with the gate voltage. As a result, organic EL element 2 emits light at an intensity that accords with the data voltage that was supplied to data line 8.

In EL display 1, data voltage and scan voltage are applied in a matrix to M rows of data lines 8 and N columns of scan lines 9, and each of M rows and N columns of organic EL elements 2 are therefore lit at different intensities, thereby displaying a dot-matrix image with the gray scale expressed in pixel units.

In such a case, the scan voltage is applied in order one column at a time to N columns of scan lines 9 in EL display 1 as shown in FIG. 2*a* and FIG. 2*b*, and when this scan voltage is being applied, one column of M data voltages is therefore applied in order to M rows of data lines 8.

The state in which the drive voltage is applied to organic EL element 2 in accordance with the data voltage that is held by capacitor 6 as described in the foregoing explanation continues even when switching TFT 7 is placed in the OFF state by the scan voltage of scan line 9. Organic EL element 2 thus continues emission that is controlled to a predetermined luminance until the next instance of control, and EL display 1 therefore is capable of displaying a bright and high-contrast image.

In EL display 1 in which organic EL elements 2 are actively driven as described above, however, organic EL elements 2 have a short life. Various explanations can be offered, but characteristically, it is clear that continuous application of the drive voltage of the same polarity to organic EL electrodes 2 results in a short life of the elements.

In an EL display (not shown) that passively drives organic EL elements 2, for example, it has been confirmed that organic EL elements 2 have a longer life than in the case of active drive because the polarity of voltage applied to organic EL elements 2 reverses during the drive process. A passive-type EL display as described hereinabove, however, is incapable of driving organic EL elements 2 at both high luminance and high contrast, and such a display is therefore difficult to use in devices requiring high luminance.

SUMMARY OF THE INVENTION

It is an object of the present invention to provide an image display device capable of employing active drive to light organic EL elements at high luminance and high efficiency while enabling longer life of the elements.

According to one aspect of the present invention, (M×N) organic EL elements are arranged two-dimensionally in M rows and N columns, (M×N) data voltages that individually set the light-emission luminance of these (M×N) organic EL elements are applied in order N times for each of the M rows of data lines, and the scan voltage is applied in order to the N columns of scan lines in synchronization with the data voltages that are applied to these M rows of data lines. The scan voltage that is applied in order to these N columns of scan lines causes the M rows and N columns of switching elements to turn on one column at a time, and the (M×N) data voltages that are applied from the M rows of data lines in accordance with the ON state of these M rows and N columns of switching elements are individually held by M rows and N columns of data voltage holding means. The drive voltage that is constantly applied to the power supply electrode is applied to the (M×N) organic EL elements by the M rows and N columns of drive transistors in individual correspondence to the held voltage of the (M×N) voltage holding means. The M rows and N columns of organic EL elements are thus actively driven at individually differing luminances to display a multiple gray-scale dot matrix image.

Immediately before the application of the scan voltage to the scan line of the nth column, however, a conduction control element halts the application of the drive voltage to the M organic EL elements of the nth column. As a result, conduction to the actively driven organic EL elements is halted an instant before performing display control of the image, even when an image is continuously displayed at the same luminance, thereby enabling a longer life of the organic EL elements.

According to another aspect of the present invention, a conduction control element applies a reverse voltage, which has the opposite polarity of the drive voltage, to the M organic EL elements of the nth column immediately before the scan voltage is applied to the scan line of the nth column. As a result, the polarity of voltage that is applied to actively driven organic EL elements is reversed an instant before performing display control of the image, even when an image is continuously displayed at the same luminance, thereby enabling a longer life of organic EL elements.

In an embodiment, when a scan voltage is applied to the scan line of the (n−a)th column, a conduction control element halts the application of the drive voltage to the organic EL elements of the nth column. As a result, the application of the drive voltage to the M organic EL elements of the nth column can be simply and reliably halted at a desired timing immediately before the scan voltage is applied to the scan line of the nth column.

In an embodiment, when the scan voltage is applied to the scan lines of the (n−a)th column, a conduction control element applies a reverse voltage to the organic EL elements of the nth column. As a result, application of a reverse voltage, which has the opposite polarity of the drive voltage, to the M organic EL elements of the nth column can be simply and reliably performed at a desired timing immediately before the scan voltage is applied to the scan lines of the nth column.

In an embodiment, when the scan voltage is applied to the scan lines of the (n−a)th column, a conduction control element halts the application of the drive voltage to the organic EL elements of the nth column and applies a reverse voltage. As a result, the application of a reverse voltage, which has a polarity opposite that of the drive voltage, to the M organic EL elements of the nth column can be simply and reliably carried out at a desired timing immediately before the scan voltage is applied to the scan lines of the nth column.

In an embodiment, when a scan voltage is applied to the scan lines of the (n−b)th column, a conduction control element halts the application of the drive voltage to the organic EL elements of the nth column, and when a scan voltage is applied to the scan lines of the (n−a)th column, the conduction control element applies a reverse voltage to the organic EL elements of the nth column. Accordingly, a reverse voltage can be reliably conducted to the organic EL elements after the application of the drive voltage to the organic EL elements has been reliably halted.

In an embodiment, when a scan voltage is applied to the scan lines of the (n−a)th column, a conduction control element discharges the voltage held by a voltage holding means of the nth column. As a result, application of the drive voltage to the organic EL elements can be simply and reliably halted by controlling the voltage holding means.

In an embodiment, when a scan voltage is applied to the scan lines of the (n−a)th column, a conduction control element disconnects the connection between the power supply electrode and the organic EL elements of the nth column. As a result, the application of drive voltage to the organic EL elements can be reliably halted.

In an embodiment, a conduction control element conducts the scan voltage that is applied to the scan lines of the (n−a)th column to the organic EL elements of the nth column as the reverse voltage. As a result, the scan voltage can be used as the reverse voltage that is conducted to the organic EL elements, and a proper reverse voltage can be reliably generated by means of a simple construction.

In an embodiment, when a scan voltage is applied to the scan lines of the (n−b)th column, a conduction control element discharges the voltage that is held by the voltage holding means of the nth column and conducts the scan voltage that is applied to the scan lines of the (n−a)th column to the organic EL elements of the nth column as the reverse voltage. Accordingly, the application of drive voltage to the organic EL elements by the scan voltage of the scan lines of the (n−b)th column can be halted through control of the voltage holding means, the scan voltage of the scan lines of the (n−a)th column can be conducted as the reverse voltage to the organic EL elements for which this current conduction has been halted, and a reverse voltage can be applied to organic EL elements for which the drive voltage has been completely halted.

In an embodiment, when a scan voltage is applied to the scan lines of the (n−b)th column, a conduction control element disconnects the connection between the power supply electrode and the organic EL elements of the nth column and conducts the scan voltage that is applied to the scan lines of the (n−a)th column to the organic EL elements of the nth column as a reverse voltage. Accordingly, the application of drive voltage to the organic EL elements by the scan voltage of the scan lines of the (n−b)th column can be halted by disconnecting the power supply electrodes, the scan voltage of the scan lines of the (n−a)th column can be conducted as the reverse voltage to the organic EL elements for which this current conduction has been halted, and a reverse voltage can be applied to the organic EL elements for which the drive voltage has been completely halted.

In an embodiment, a is equal to 1. Accordingly, the conduction control element controls conduction to organic EL elements when the scan voltage is applied to the scan lines of the preceding column, but control of conduction to the organic EL elements of the first column is effected when the scan voltage is applied to the scan lines of the Nth column, which is the last column. Accordingly, the control of conduction to the organic EL elements of the first column at a proper timing and by a simple construction can be realized by a construction in which a conduction control element controls conduction to organic EL elements when the scan voltage is applied to the scan lines of the preceding column.

In an embodiment, a is equal to 1. Accordingly, a conduction control element controls conduction to organic EL elements when the scan voltage is applied to the scan lines of the preceding column, but a dummy scan voltage is applied to a dummy line that is provided parallel to the scan line of the first column immediately before application of the first-column scan voltage. Accordingly, control of conduction to the organic EL elements of the first column is performed when the dummy scan voltage is applied to the dummy line. As a result, the control of conduction to the organic EL elements of the first column at a proper timing and by a simple construction can be realized by a construction in which the conduction control element controls conduction to organic EL elements when the scan voltage is applied to the preceding scan line.

In an embodiment, a is equal to 1 and b is equal to 2. Accordingly, a conduction control element halts the drive voltage that is applied to organic EL elements when the scan voltage is applied to the scan line of the second preceding column, and the conduction control element applies a reverse voltage to organic EL elements when the scan voltage is applied to the scan lines of the preceding column. However, the drive voltage to the organic EL elements of the first column is halted when the scan voltage is applied to the scan line of the (N−1)th column, and a reverse voltage is conducted to the organic EL elements of the first column when the scan voltage is applied to scan line of the Nth column. The drive voltage to the organic EL elements of the second column is halted when the scan voltage is applied to the scan lines of the Nth column. Accordingly, conduction to the organic EL elements of the first column and second column can be controlled at a proper timing and by a simple construction by a construction in which the conduction control element halts the drive voltage that is applied to the organic EL elements when the scan voltage is applied to the second preceding scan line and applies a reverse voltage to organic EL elements when the scan voltage is applied to the scan line of the preceding column.

In an embodiment, a is equal to 1 and b is equal to 2. Accordingly, a conduction control element halts the drive voltage that is applied to organic EL elements when the scan voltage is applied to the scan line of the second preceding column, and the conduction control element applies a reverse voltage to organic EL elements when the scan voltage is applied to the scan lines of the preceding column. However, first and second dummy scan voltages are applied to first and second dummy lines that are provided parallel to the scan line of the first column immediately before application of the first-column scan voltage. As a result, the drive voltage to the organic EL elements of the first column is halted when the scan voltage is applied to the first dummy line, and a reverse voltage is conducted when the scan voltage is applied to the second dummy line. The drive voltage to the organic EL elements of the second column is halted when the scan voltage is applied to the second dummy line. Accordingly, conduction to the organic EL elements of a first column and second column at a proper timing and by a simple construction can be realized by a construction in which a conduction control element halts the drive voltage that is applied to organic EL elements when the scan voltage is applied to the scan line of the second preceding column and applies a reverse voltage to organic EL elements when the scan voltage is applied to the scan line of the preceding column.

The above and other objects, features, and advantages of the present invention will become apparent from the following description with reference to the accompanying drawings which illustrate examples of the present invention.

BRIEF DESCRIPTION OF THE DRAWINGS

FIG. 10 is a timing chart showing the signal waveforms of each component;

FIG. 11 is a circuit diagram showing the circuit structure of the principal components of the EL display of the fourth embodiment;

DETAILED DESCRIPTION OF THE PREFERRED EMBODIMENTS

For the sake of convenience in the explanations of the embodiments hereinbelow, "rows" refers to the dimension that is parallel to the vertical direction in the figures, and "columns" refers to the dimension that is parallel to the horizontal direction.

First Embodiment

Figure 1:
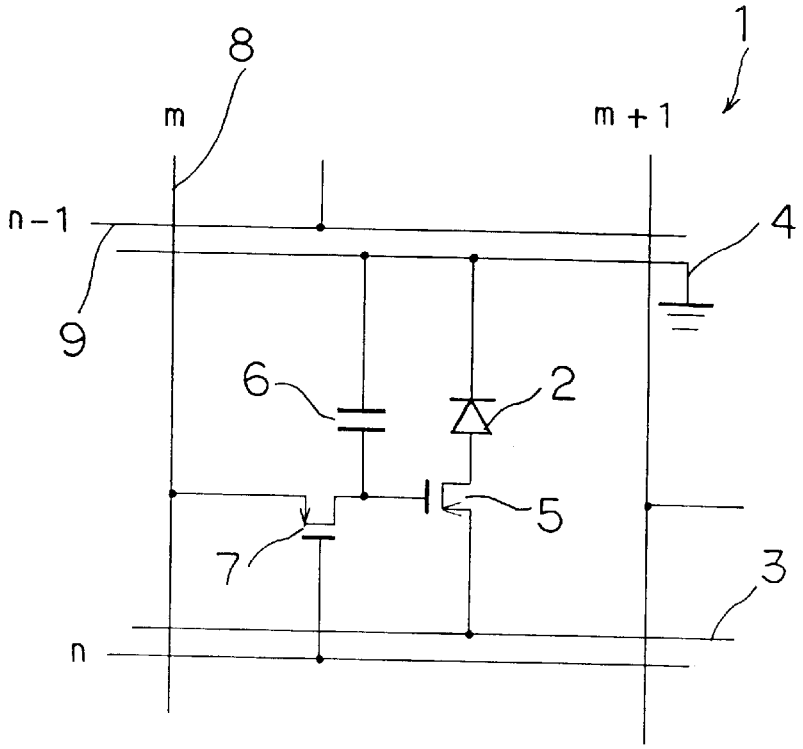
Fig.1(Prior Art)
FIG. 1 is a circuit diagram showing the principal features of an EL display of the prior art.
Figures 2A, 2B, 2C, 2D, 2E, 2F:
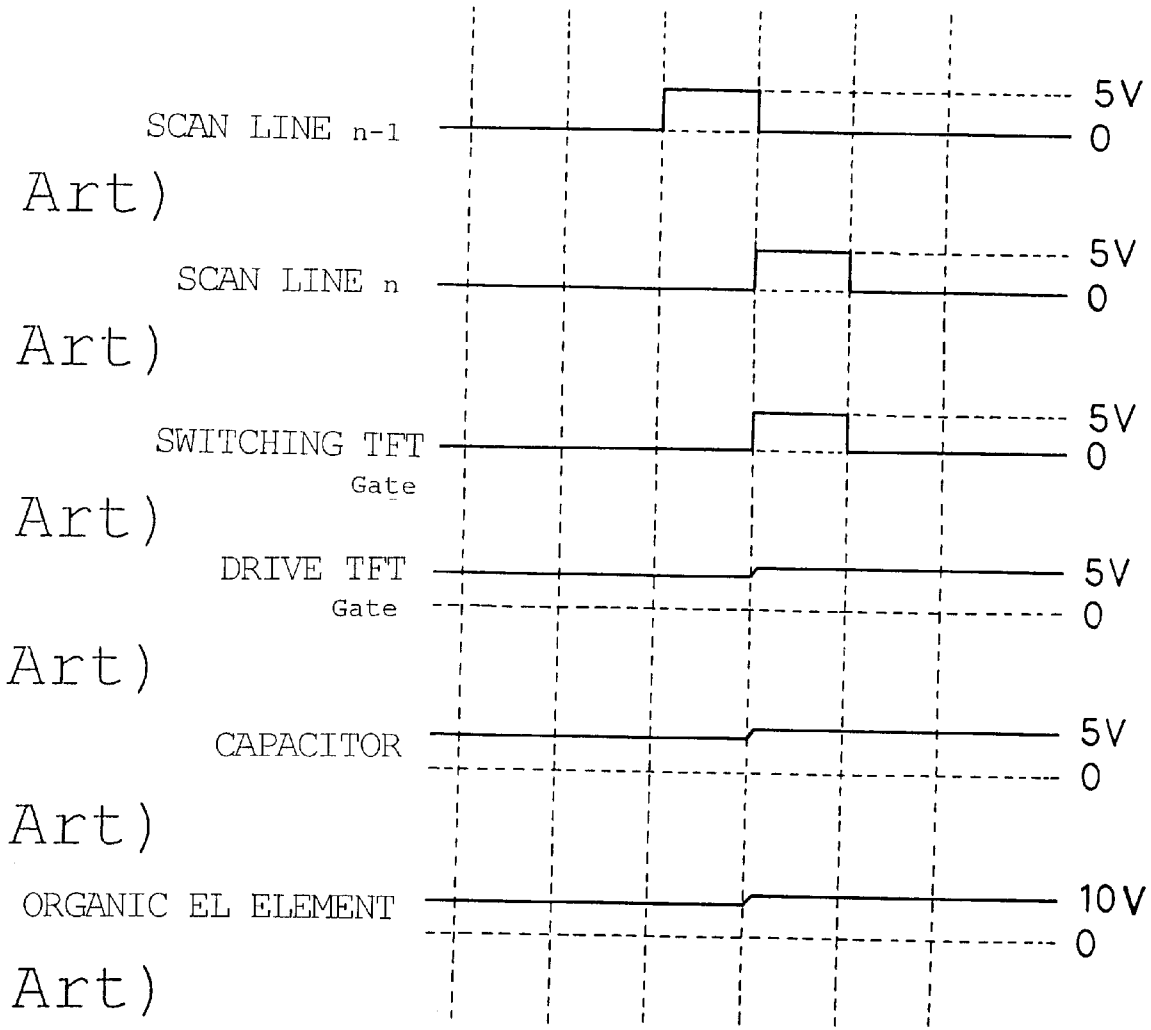
Fig.2a (Prior Art)
Fig.2b (Prior Art)
Fig.2c (Prior Art)
Fig.2d (Prior Art)
Fig.2e (Prior Art)
Fig.2f (Prior Art)
FIG. 2 is a timing chart showing the signal waveform of each part.
Figure 3:
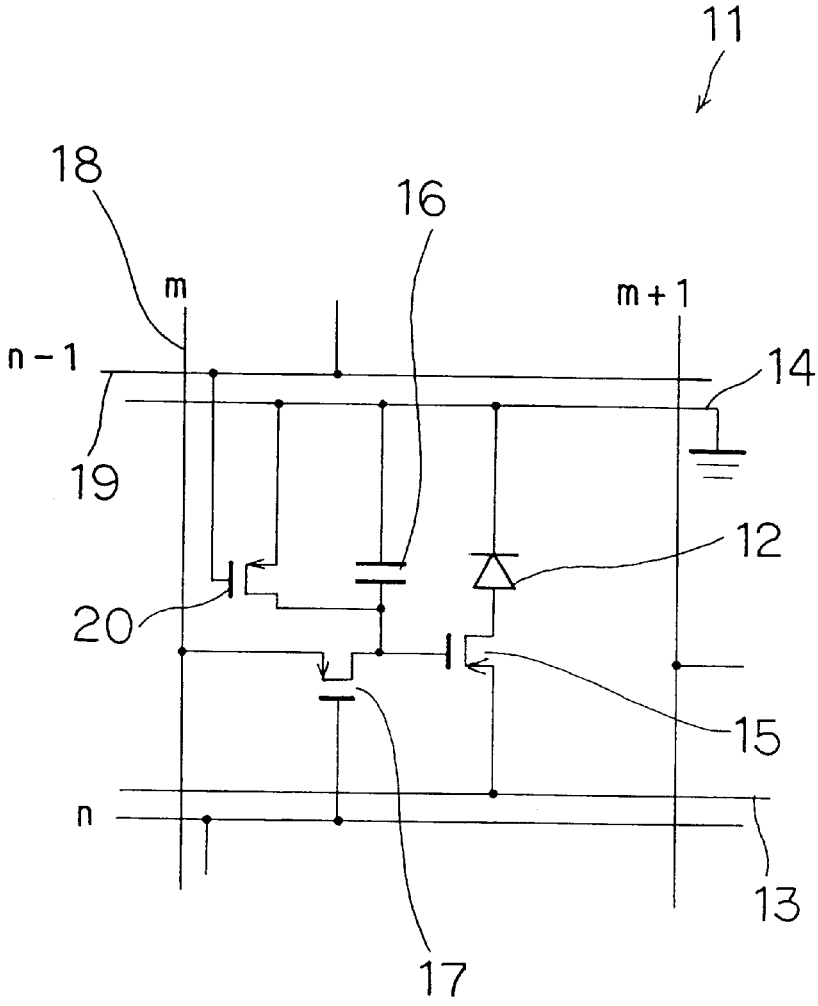
FIG. 3 is a circuit diagram showing the circuit configuration of the principal components of the EL display, which is the image display device of the first embodiment of the present invention.
Figure 4:
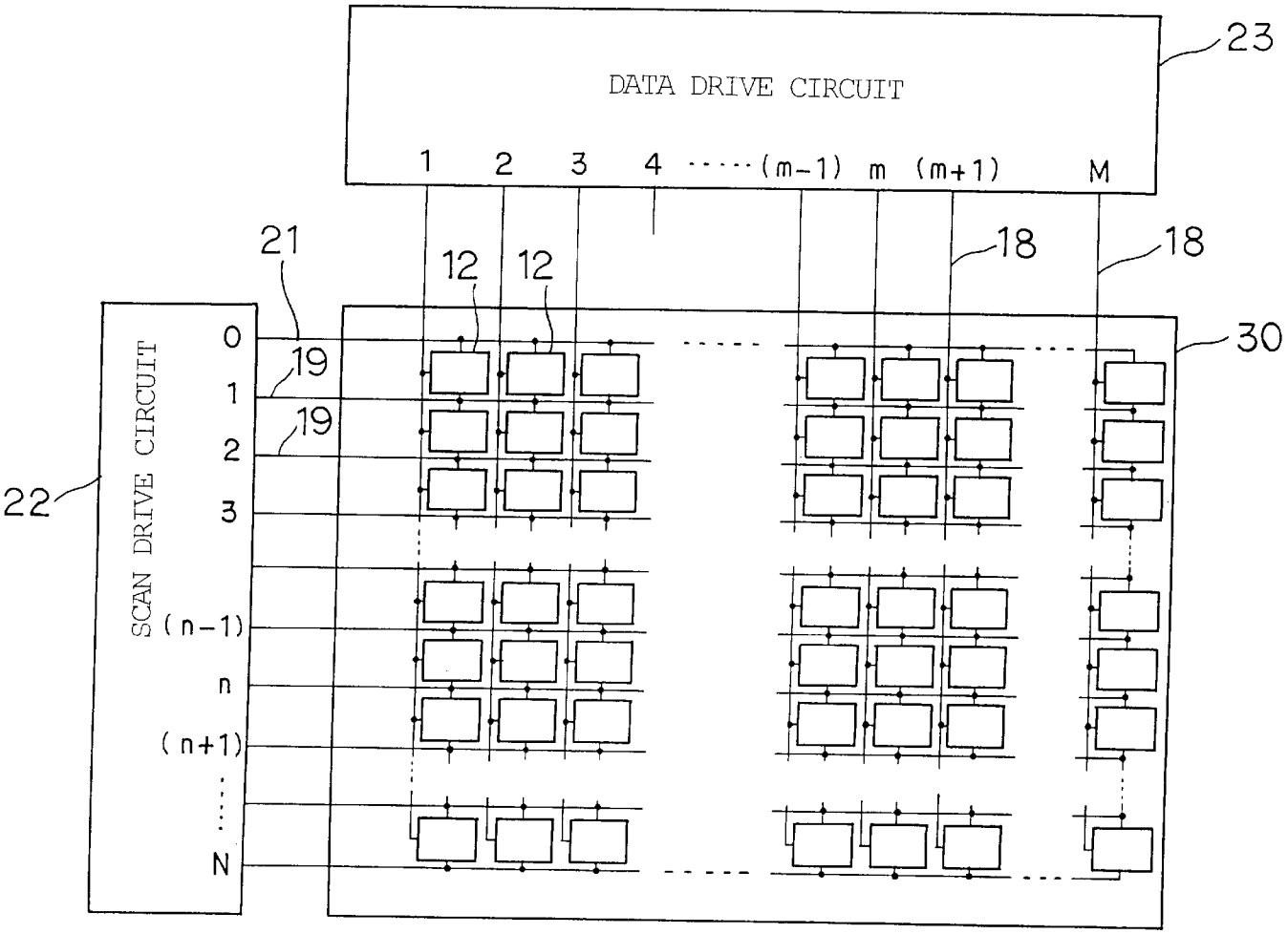
FIG. 4 is a block diagram showing the overall construction of the EL display.

Referring now to FIG. 3, there is shown an EL display 11 which includes (M×N) organic EL elements 12 as in the EL display in the example of the prior art (M and N are predetermined natural numbers). As shown in FIG. 4, these (M×N) organic EL elements 12 are arranged two-dimensionally in M rows and N columns.

EL display 11 follows the standards of VGA (Video Graphics Array), and outputs a display of color images by an RGB (Red, Green, and Blue) system. Accordingly, (480 (1980) organic EL elements 12 are arranged in 480 rows, and 1920 columns.

EL display 11 includes power supply line 13 and ground line 14 as the pair of power supply electrodes. Organic EL element 12 is directly connected to ground line 14 but is connected to power supply line 13 by way of drive TFT 15, which is a drive transistor.

Capacitor 16 is connected as a voltage holding means to the gate electrode of this drive TFT 15. This capacitor 16 is also connected to ground line 14. The drain electrode of switching TFT 17, which is a switching element, is connected to this capacitor 16 and the gate electrode of drive TFT 15. The source electrode of this switching TFT 17 is connected to data line 18 and the gate electrode is connected to scan line 19.

In contrast to EL display 1 of the example of the prior art, however, M rows and N columns of control TFTs 20 are provided in the M rows and N columns of organic EL elements 12 in EL display 11 of this embodiment, one control TFT 20 being provided for each of organic EL elements 12. These control TFTs 20 function as conduction control elements that halt the application of the drive voltage to the M organic EL elements 12 of the nth column immediately before the scan voltage, which is a rectangular pulse of 5.0 (V), is applied to scan line 19 of the nth column.

These control TFTs 20 have drain electrodes connected to the wiring that connects capacitor 16 and drive TFT 15, and source electrodes connected to ground line 14. Since the gate electrodes of the M control TFTs 20 of the nth column are connected to scan line 19 of the (n−1)th column, however, the voltage 5.0–0.0 (V) that is held by capacitors 16 of the nth column is discharged when the scan voltage is applied to scan line 19 of the (n−1)th column.

For control TFTs 20 of the first column in which n=1, however, there is no (n−1)th column scan line 19. Here, in EL display 11, dummy line 21 is provided parallel to scan line 19 of the first column as shown in FIG. 4, and the gate electrodes of the M control TFTs 20 of the first column are connected to this dummy line 21.

Scan lines 19 for N columns and dummy line 21 for one column are then connected to one scan drive circuit 22. For each screen display, this scan drive circuit 22 applies (N+1) scan voltages in order to the dummy line 21 for one column and scan lines 19 for N columns, and as a result, a dummy scan voltage is applied to dummy line 21 immediately before the scan voltage is applied to first-column scan line 19.

In addition, the M rows of data lines 18 are connected to one data drive circuit 23. For each screen display, this data drive circuit 23 applies (M×N) data voltages of 5.0–0.0 (V) in order to each of the M rows of data lines 18 in synchronization with the N scan voltages, whereby M data voltages are held in order in the M capacitors 16 for each column.

Figure 5:
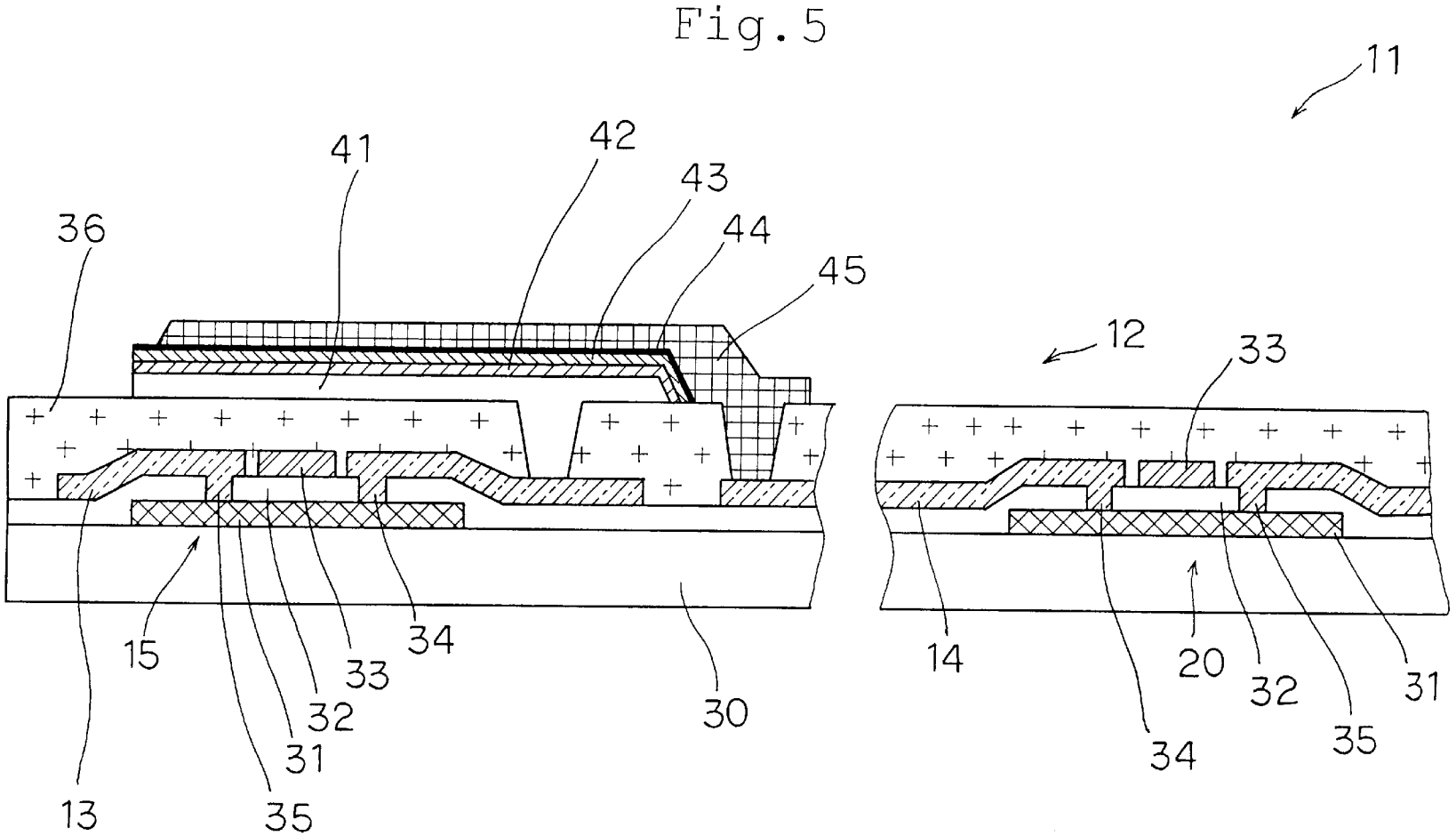
FIG. 5 is a sectional diagram showing the thin-film structure of an organic EL element.

In EL display 11 of this embodiment as well, each of the components such as the above-described organic EL elements 12 are formed as a laminated construction on one surface of one glass substrate 30 as shown in FIG. 4 and FIG. 5. More specifically, drive TFT 15 or control TFT 20 are formed on islands 31 made of p-Si and stacked on the surface of glass substrate 30 as shown in FIG. 5, and gate oxide layers 32 are stacked on these islands 31.

Gate electrode 33 of a metal such as aluminum is stacked in the center of gate oxide layer 32, and a source electrode 34 and drain electrode 35 are connected on both sides of gate oxide layer 32. These electrodes 34 and 35 are formed as a unit with power supply line 13 and ground line 14, and the above-described construction is uniformly sealed by insulating layer 36.

Organic EL elements 12 are formed on the surface of insulating layer 36. Anode 41 formed from ITO (Indium Tin Oxide) is laminated on the surface of this insulating layer 36. Positive-hole transport layer 42, light-emitter layer 43, electron transport layer 44, and metallic cathode 45 are successively stacked on this anode 41, thereby forming organic EL element 12.

In addition, contact holes are formed at key points of insulating layer 36 as described hereinabove, and these contact holes connect anode 41 of organic EL element 12 and source electrode 34 of drive TFT 15 as well as cathode 45 and ground line 14.

EL display 11 connects various lines such as 13 and 14, various elements such as 15 and 16, and various circuits such as 22 and 23 to the above-described M rows and N columns of organic EL elements 12, and displays an image in accordance with image data that are applied from the outside. Organic EL elements 12 are formed from light-emitter layer 43 as shown in FIG. 5, and as shown in FIG. 4, these organic EL elements 12 are individually formed in a shape that corresponds to the M rows and N columns of pixel areas of EL display 11.

As with EL display 1 of the example of the prior art, EL display 11 of this embodiment in the above-described construction can cause light emission of a desired luminance in each of the M rows and N columns of organic EL elements 12 to display a multiple gray-scale dot-matrix image in pixel units, and in particular, can achieve high efficiency and high luminance due to the active drive of organic EL elements 12.

Figures 6A, 6B, 6C, 6D, 6E, 6F, 6G:
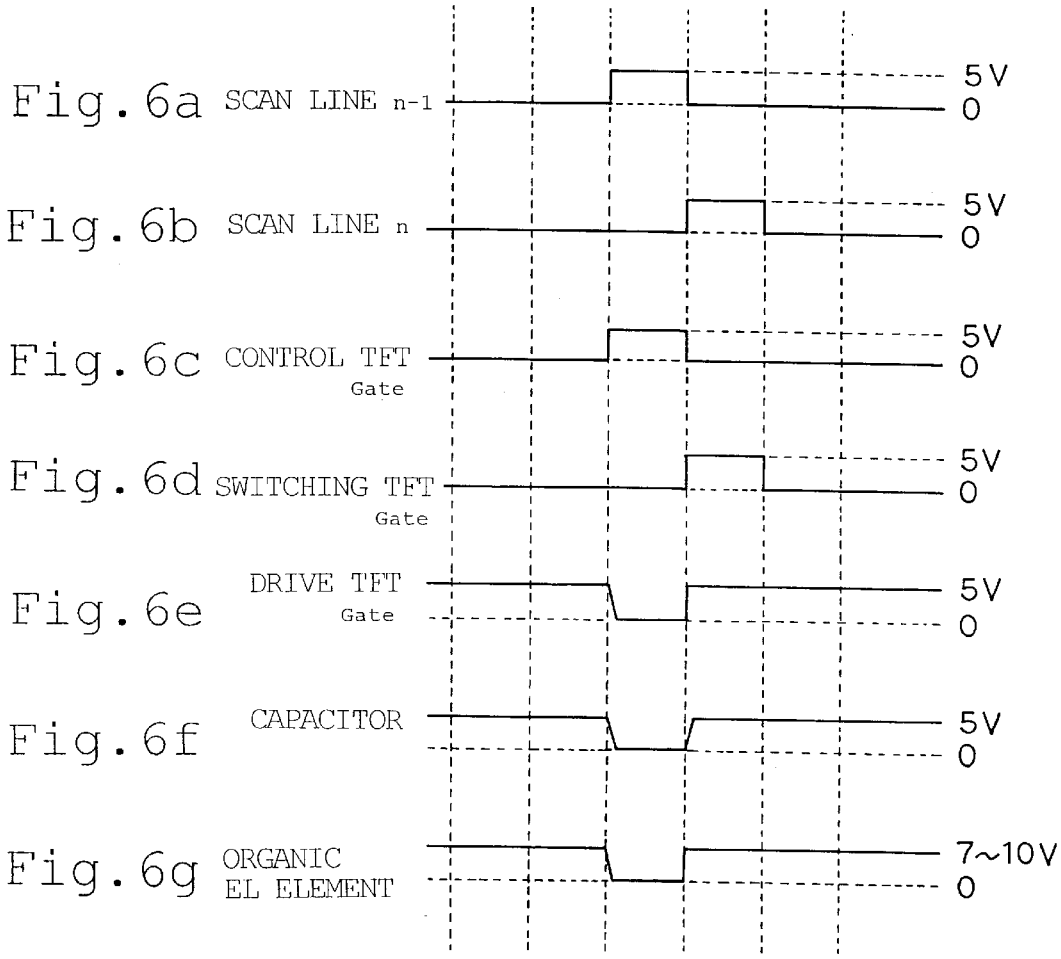
FIG. 6 is a timing chart showing the signal waveform of each component of the EL display.

In this case, as shown in FIG. 6, scan voltage is applied in order to the N columns of scan line 19 to successively turn on the M rows and N columns of switching TFTs 17 one column at a time, whereby data voltages that correspond to the light-emission luminances of the M organic EL elements 12 in one column are individually applied to the M rows of data lines 18.

These M data voltages are then individually held in the M capacitors 16 of one column by way of switching TFT 17 and the voltages held in these capacitors 16 are individually applied to the gate electrodes of the M drive TFTs 15 of one column, whereby the drive voltage that is constantly applied to power supply line 13 is supplied by drive TFT 15 to the M organic EL elements 12 of one column.

The current volume corresponds to the voltage that is applied from capacitors 16 to the gate electrodes of drive TFTs 15, and as a result, the M organic EL elements 12 of one column emit light at luminances that correspond to the control currents that are supplied to data lines 18, and this operating state is maintained by the voltage held by capacitors 16 even if the scan voltage should enter an OFF state.

The above-described operation is performed in order for each of the N columns of scan lines 19, whereby EL display 11 can cause the M rows and N columns of organic EL elements 12 to individually emit light at desired luminances and display a gray-scale dot matrix image in pixel units. Moreover, high luminance can be realized with high efficiency because the light emitting state of organic EL elements 12 is maintained by means of the voltages held by capacitors 16 until the next light emission control.

Although the above-described organic EL elements 12 are actively driven in EL display 11, conduction to organic EL elements 12 is instantaneously halted immediately before performance of light emission control. More specifically, when the scan voltage is applied to scan line 19 of the (n−1)th column, this scan voltage causes control TFT 20 of the nth column to turn on, whereby both ends of capacitor 16 of the nth column are connected to ground line 14, and conduction to organic EL elements 12 of the nth column is halted.

The light-emitting state of organic EL elements 12 in EL display 11 is thus maintained by active drive until the next light emission control, but because conduction to organic EL elements 12 is instantaneously halted immediately before this light-emitting control, the life of the actively driven organic EL elements 12 can be extended.

In particular, because the temporary halt of conduction to organic EL elements 12 is controlled by the scan voltage of scan line 19 of the preceding column, the conduction of electricity to organic EL elements 12 can be reliably controlled at the optimum timing.

Moreover, a parallel dummy line 21 is provided before scan line 19 of the first column, and conduction to organic EL elements 12 of the first column is halted by means of the dummy scan voltage that is applied to this dummy line 21, thereby enabling reliable control at the optimum timing of conduction to all M rows and N columns of organic EL elements 12.

Although the above-described embodiment describes a case in which conduction to organic EL elements 12 of the nth column is temporarily halted at the timing of the scan voltage of scan line 19 of the (n−1)th column, the timing of the scan voltage of scan line 19 of the (n−a)th column is also possible.

If a is equal to 2 or more, however, the number of dummy lines 21 must also be increased, the time for extinguishing organic EL elements 12 increases, and the overall luminance decreases. The optimal value of a is equal to therefore generally 1.

Further, although the above-described embodiment describes a case in which dummy line 21 is provided parallel to scan line 19 of the first column and a dummy scan voltage is applied, scan line 19 of the Nth column, i.e., the last column, may be connected to control TFT 20 of the first column and the conduction of electricity to organic EL elements 12 of the first column may be temporarily halted by the scan voltage that is applied to scan line 19 of the Nth column.

A construction in which an additional dummy line 21 is added necessitates the addition of an internal circuit of scan drive circuit 22 as well as dummy line 21, but avoids troublesome wiring. On the other hand, although a construction in which scan line 19 of the Nth column is connected to control TFT 20 of the first column may require troublesome wiring, the necessity for adding dummy line 21 and internal circuits of scan drive circuit 22 can be avoided.

Essentially, these constructions each have advantages and disadvantages, and the optimum form is appropriately selected with due consideration given to the various conditions when actually working the device.

Finally, the above-described embodiment describes a case in which M rows and N columns of control TFTs 20 are arranged to control conduction to M rows and N columns of organic EL elements 12. However, since it is sufficient that control TFTs 20 control conduction to one column of M organic EL elements 12 for each scan voltage, it is also possible to, for example, connect N control TETs 20 one at a time to one scan line 19 of the N columns and M organic EL elements 12 of one column.

A construction in which control TFTs 20 are also arranged in M rows and N columns may increase circuit scale but avoid troublesome wiring, while a construction in which only N columns of control TFTs 20 are arranged may require troublesome wiring but reduce circuit scale. Again, the best form is appropriately selected according to actual conditions.

Finally, in the actual fabrication of EL display 11, a construction in which control TFTs 20 are also arranged in M rows and N columns is easy to manufacture because thin-film circuits of the same pattern are formed in M rows and N columns. If control TFTs 20 are arranged in only N columns, however, control TFTs 20 are ideally located at the ends of each column at the periphery of the pixel area and formed separately.

Second Embodiment

The components in the second and succeeding embodiments which correspond to the components of the first embodiment are assigned identical reference numerals and are not further discussed.

Figure 7:
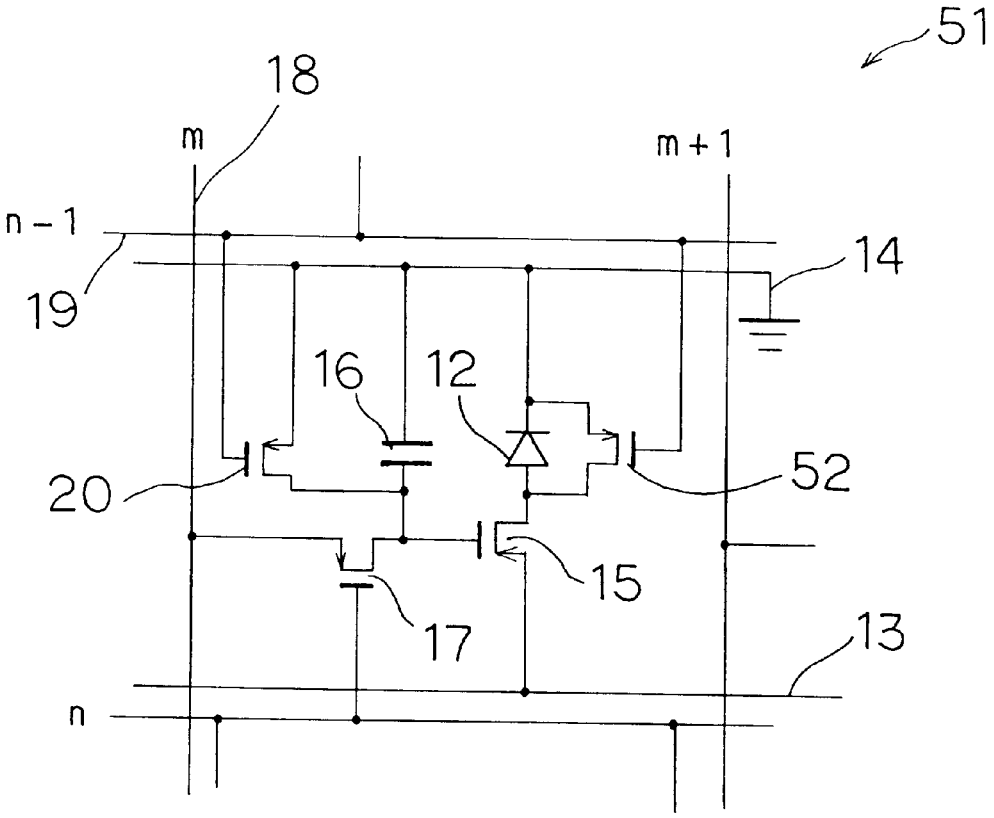
FIG. 7 is a circuit diagram showing the circuit structure of the principal components of the EL display of the second embodiment.

Referring to FIG. 7, EL display 51 includes M rows and N columns of second control TFTs 52 in addition to M rows and N columns of first control TFTs 20 as the conduction control elements that halt the application of the drive voltage to the M organic EL elements 12 of the nth column immediately before the scan voltage is applied to scan line 19 of the nth column, each of organic EL elements 12 having one first control TFT 20 and one second control TFT 52.

Second control TFT 52 of the nth column has its gate electrode connected to scan line 19 of the (n−1)th column and its two ends connected to the two sides of organic EL element 12. In the first column, the gate electrode of this second control TFT 52 is connected to a dummy line, such as discussed above and illustrated in FIG. 4 as dummy line 21.

In the construction described above, EL display 51 of this embodiment also instantaneously halts conduction to actively driven organic EL elements 12 immediately before light emission control, as in EL display 11 described hereinabove as the first embodiment.

Figures 8A, 8B, 8C, 8D, 8E, 8F, 8G, 8H:
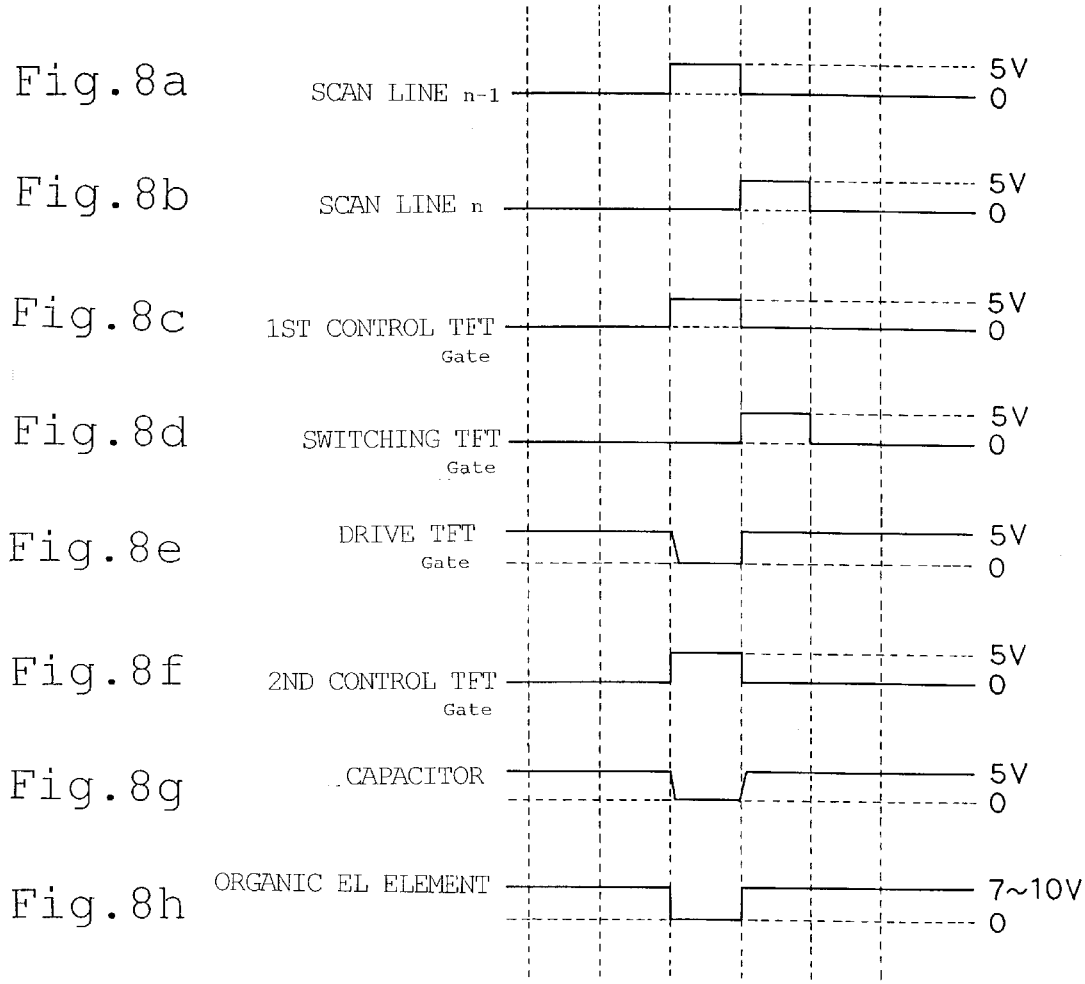
FIG. 8 is a timing chart showing the signal waveform of each component.

In such a case, as shown in FIG. 8, both first and second control TFTs 20 and 52 of the nth column are turned on by means of the scan voltage that is applied to scan line 19 of the (n−1)th column, whereupon both ends of capacitors 16 of the nth column are connected to ground line 14 and both ends of organic EL elements 12 of the nth column are short-circuited.

As a result, conduction to organic EL elements 12 in EL display 51 can be temporarily halted with increased reliability, and the life of actively driven organic EL elements 12 can be more effectively extended. Alternatively, the above-described second control TFT 52 may be used in only N columns instead of in M rows and N columns.

Third Embodiment

Figure 9:
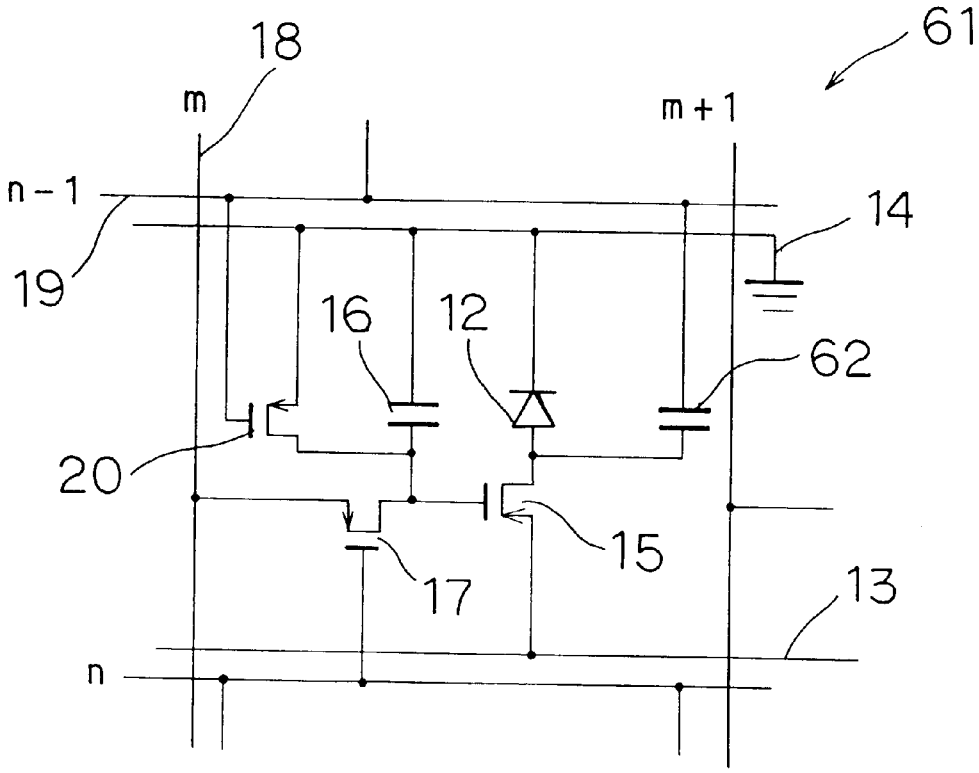
FIG. 9 is a circuit diagram showing the circuit structure of the principal components of the EL display of the third embodiment.

Referring to FIG. 9, EL display 61 includes control capacitors 62 as a conduction control element in addition to the M rows and N columns of first control TFTs 20, M rows and N columns of organic EL elements 12 each having one first control TFT 20 and one control capacitor 62.

Control capacitor 62 of the nth column has one end connected to scan line 19 of the (n−1)th column and the other end connected to the connection point of organic EL element 12 and drive TFT 15. In addition, control capacitor 62 in the first column has one end connected to dummy line 21.

In the above-described construction, the scan voltage that is applied to scan line 19 of the (n−1)th column in EL display 61 of this embodiment both causes control TFT 20 of the nth column to turn on as shown in FIG. 8 and the voltage of the scan voltage to be applied to one end of control capacitor 62.

As shown in FIG. 10, this state causes spike noise of the opposite polarity to be generated at the other end of control capacitor 62, and this spike noise is conducted to organic EL elements 12 as a reverse voltage that is of the opposite polarity of the drive voltage. As a result, a reverse voltage having the opposite polarity of the drive voltage can be applied immediately before light-emission control of organic EL elements 12 in EL display 61, and the life of organic EL elements 12 can be more effectively extended.

Moreover, in order to more reliably conduct the spike noise, which is generated by control capacitor 62 in EL display 61 as described hereinabove, to organic EL elements 12 as a reverse voltage, a predetermined time interval is preferably set to scan voltages that are applied in order to the N columns of scan lines 19, as shown in FIG. 10.

Fourth Embodiment

Referring to FIG. 11, EL display 71 includes, as conduction control elements, third to fifth control TFTs 72–74 in addition to M rows and N columns of first control TFTs 20; one each of first control TFT 20, third control TFT 72, fourth control TFT 73, and fifth control TFT 74 being included for each organic EL element of the M rows and N columns.

Third control TFT 72 has its gate electrode connected to capacitor 16 in parallel with drive TFT 15, its source electrode connected to ground line 14, and its drain electrode connected to the end of organic EL element 12 that is opposite drive TFT 15.

As a result, third control TFT 72, as with drive TFT 15, supplies the drive voltage that is applied from power supply line 13 to ground line 14 to organic EL element 12 in accordance with the voltage that is held by capacitor 16, whereby organic EL element 12 is disconnect from power supply line 13 and ground line 14 when the voltage held by capacitor 16 is discharged.

The gate electrode and source electrode of fourth control TFT 73 of the nth column are connected to scan line 19 of the (n−1)th column, and the drain electrode of fourth control TFT 73 is connected to the connection point between organic EL element 12 and third control TFT 72.

Fifth control TFT 74 of the nth column has its gate electrode connected to scan line 19 of the (n−1)th column, its source electrode connected to the connection point between organic EL element 12 and drive TFT 15, and its drain electrode connected to ground line 14.

Fourth and fifth control TFTs 73 and 74 of the nth column therefore turn on when a scan voltage is applied to scan line 19 of the (n−1)th column and then conduct the scan voltage from organic EL elements 12 of the nth column to ground line 14 as a reverse voltage of opposite polarity to the drive voltage.

Figures 12A, 12B, 12C, 12D, 12E, 12F, 12G, 12H, 12I, 12J:
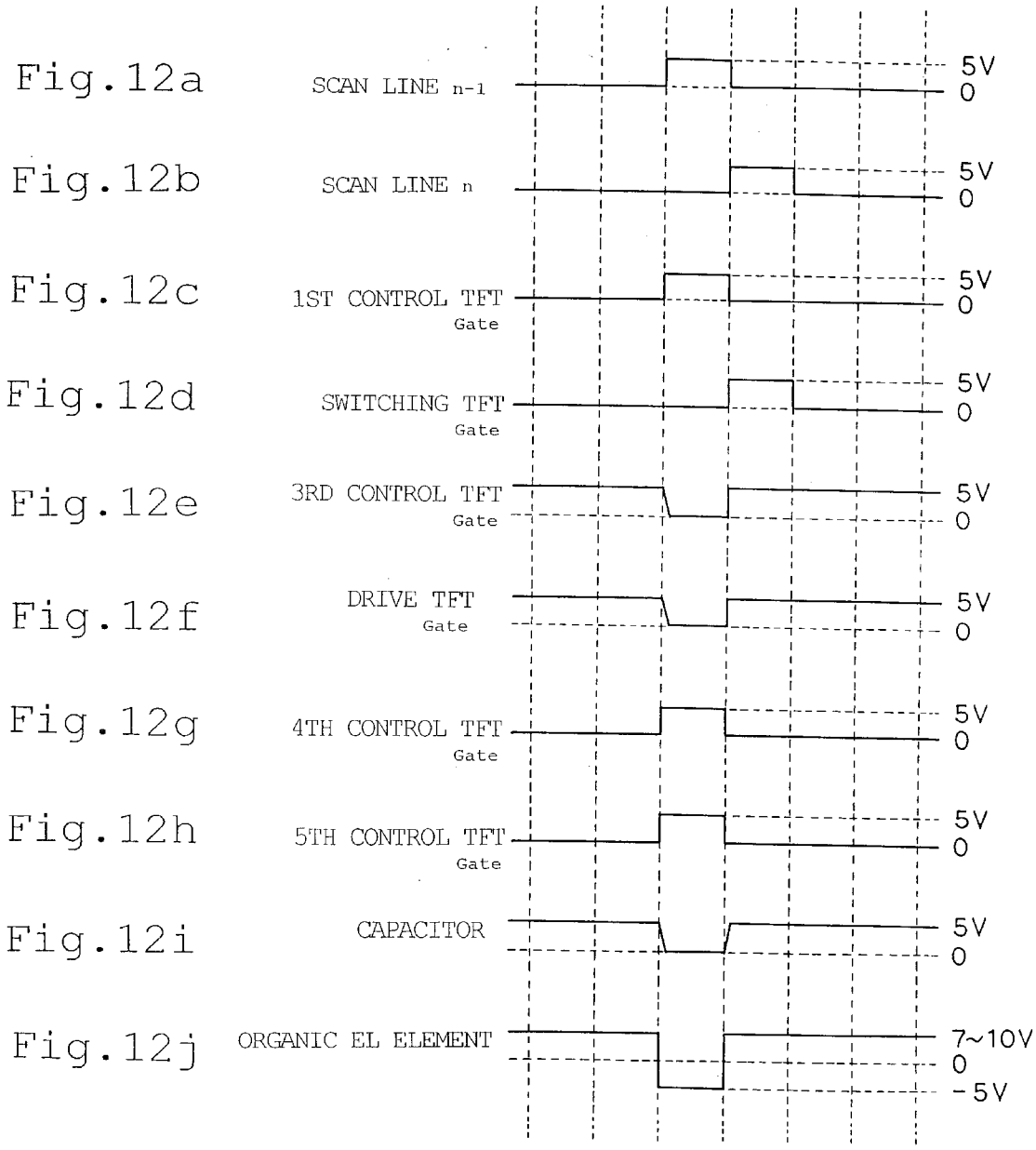
FIG. 12 is a timing chart showing the signal waveform of each component.

As shown in FIG. 12, in EL display 71 of this embodiment in the above-described construction, the scan voltage that is applied to scan line 19 of the (n−1)th column causes first control TFT 20 of the nth column to turn on to cause discharge of the voltage held by. capacitor 16 of the nth column, whereby drive TFT 15 and third control TFT 72 are turned OFF and organic EL elements 12 of the nth column float.

At the same time, the scan voltage that is applied to scan line 19 of the (n−1)th column causes fourth and fifth control TFTs 73 and 74 of the nth column to turn on to connect the two ends of organic EL elements 12 to scan line 19 of the (n−1)th column and ground line 14, whereupon the scan voltage of scan line 19 of the (n−1)th column is conducted to organic EL elements 12 as a reverse voltage having the opposite polarity of the drive voltage.

In EL display 71, therefore, a reverse voltage of polarity opposite that of the drive voltage can be reliably conducted to organic EL elements 12 immediately before light-emission control of organic EL elements 12, and the life of organic EL elements 12 can be more effectively extended.

In particular, the use of the scan voltage that is applied to scan lines 19 as the reverse voltage obviates the need for circuitry dedicated to generating the reverse voltage, and EL display 71 can apply an appropriate reverse voltage by means of a simple configuration.

Figure 13:
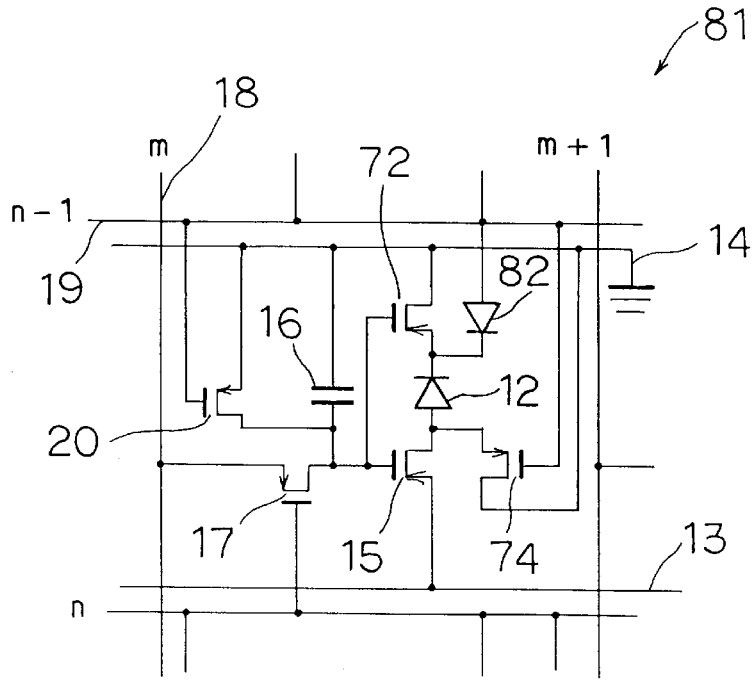
FIG. 13 is a circuit diagram showing the circuit structure of the principal components of a variant EL display.

Furthermore, fourth control TFT 73 of EL display 71 of the above-described embodiment should be capable of supplying the scan voltage to organic EL elements 12 when the scan voltage is applied to scan line 19 of the (n−1)th column. Accordingly, the above-described fourth control TFT 73 may be substituted by diode element 82 as in EL display 81 shown as a variant example in FIG. 13.

Fifth Embodiment

Figure 14:
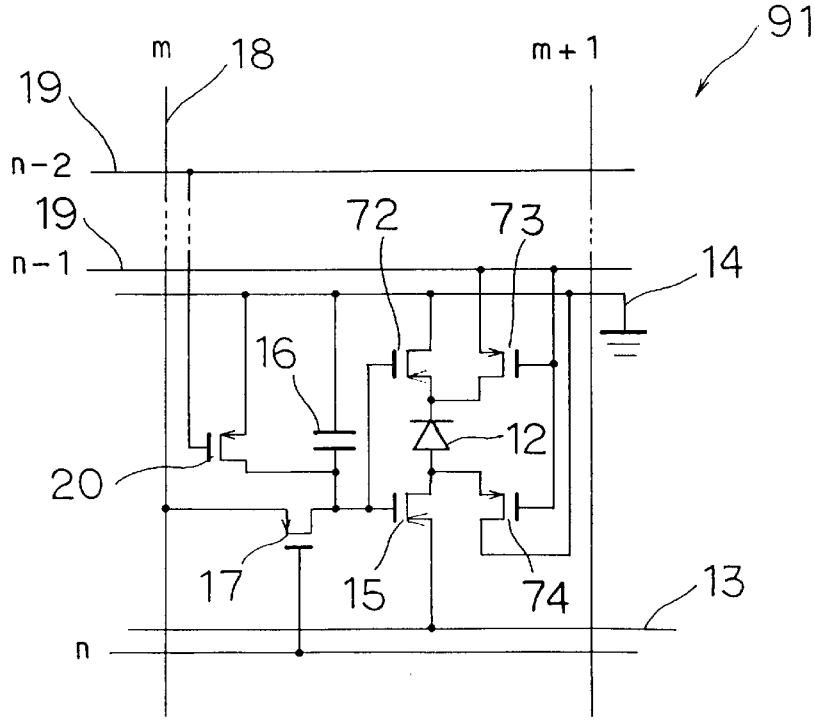
FIG. 14 is a circuit diagram showing the circuit structure of the principal components of the EL display of the fifth embodiment.

Referring to FIG. 14, there is shown an EL display 91 in which the gate electrode of nth-column first control TFT 20, which is a conduction control element, is connected to scan line 19 of the (n−2)th column. Accordingly, first control TFT 20 discharges the voltage held by capacitor 16 when the scan voltage is applied to scan line 19 of the (n−2)th column.

Figures 15A, 15B, 15C, 15D, 15E, 15F, 15G, 15H, 15I, 15J, 15K:
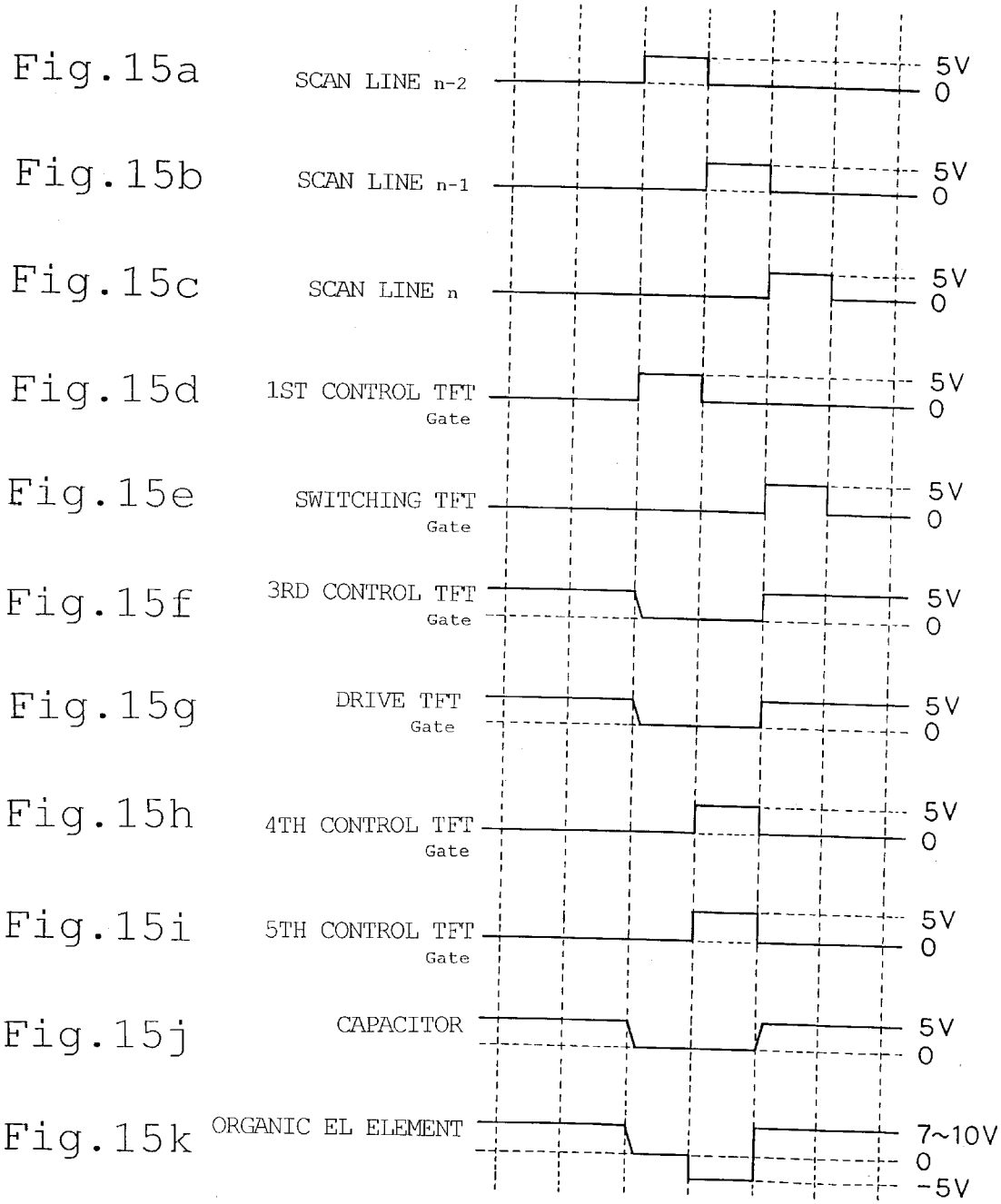
FIG. 15 is a timing chart showing the signal waveform of each component.

As shown in FIG. 15, in EL display 91 of this embodiment in the above-described construction, the voltage held by capacitor 16 is discharged at the time that the scan voltage is applied to scan line 19 of the (n−2)th column, whereby organic EL elements 12 of the nth column float. When the scan voltage is applied to scan line 19 of the (n−1)th column under these circumstances, the scan voltage is conducted to organic EL elements 12 as a reverse voltage.

In EL display 91, therefore, the application of the drive voltage to organic EL elements 12 is reliably halted immediately before light-emission control of organic EL elements 12, and the reverse voltage is conducted to organic EL elements 12 following the complete cessation of the application of the drive voltage.

As a result, the reverse voltage can be reliably conducted to organic EL elements 12 in EL display 91, and in addition, the life of organic EL elements 12 can be more effectively extended.

While preferred embodiments of the present invention have been described using specific terms, such description is for illustrative purposes only, and it is to be understood that changes and variations may be made without departing from the spirit or scope of the following claims.

What is claimed is:

1. An image display device, comprising:

(M×N) organic EL (Electro-Luminescent) elements arranged two-dimensionally in M rows and N columns, where M and N are predetermined natural numbers;

M rows of data lines to which data voltages, in which the light-emission luminances of said (M×N) organic EL elements are individually set, are applied in order;

N columns of scan lines to which a scan voltage is applied in order in synchronization with data voltages that are applied to said M rows of data lines;

M rows and N columns of switching elements that are turned on one column at a time by the scan voltage that is applied in order to said N columns of scan lines;

M rows and N columns of voltage holding means for individually holding the (M×N) data voltages that are applied from said M rows of data lines in accordance with the ON state of said M rows and N columns of switching elements;

a pair of power supply electrodes to which a predetermined drive voltage is constantly applied;

M rows and N columns of drive transistors for applying said drive voltage that is constantly applied to said power supply electrodes to said (M×N) organic EL elements in accordance with each of the voltages held by said (M×N) voltage holding means; and conduction control elements for halting the application of the drive voltage to M said organic EL elements of the nth column immediately before a scan voltage is applied to said scan line of the nth column, where $1 \leqq n \leqq N$.

2. An image display device, comprising:

(M×N) organic EL elements arranged two-dimensionally in M rows and N columns;

M rows of data lines to which data voltages, in which the light-emission luminances of said (M×N) organic EL elements are individually set, are applied in order;

N columns of scan lines to which a scan voltage is applied in order in synchronization with data voltages that are applied to said M rows of data lines;

M rows and N columns of switching elements that are turned on one column at a time by the scan voltage that is applied in order to said N columns of scan lines;

M rows and N columns of voltage holding means for individually holding the (M×N) data voltages that are applied from said M rows of data lines in accordance with the ON state of said M rows and N columns of switching elements;

a pair of power supply electrodes to which a predetermined drive voltage is constantly applied;

M rows and N columns of drive transistors for applying said drive voltage that is constantly applied to said power supply electrodes to said (M×N) organic EL elements in accordance with each of the voltages held by said (M×N) voltage holding means; and conduction control elements for applying a reverse voltage, with the opposite polarity of the drive voltage, to M said organic elements of the nth column immediately before a scan voltage is applied to said scan line of the nth column, where $1 \leqq n \leqq N$.

3. A device according to claim 1, wherein said conduction control elements comprise means for halting the application of drive voltage to said organic EL elements of the nth column when a scan voltage is applied to said scan line of the (n−a)th column, where a is equal to a natural number that is less than N.

4. A device according to claim 2, wherein said conduction control elements comprise means for applying a reverse voltage to said organic EL elements of the nth column when a scan voltage is applied to said scan line of the (n−a)th column.

5. A device according to claim 2, wherein said conduction control elements comprise means for both halting the application of drive voltage and applying a reverse voltage to said organic EL elements of the nth column when a scan voltage is applied to said scan line of the (n−a)th column.

6. A device according to claim 2 wherein said conduction control elements comprise means for halting the application of drive voltage to said organic EL elements of the nth column when a scan voltage is applied to said scan line of the (n−b)th column, where b is equal to an integer that is greater than a and less than N, and applying a reverse voltage to said organic EL elements of the nth column when a scan voltage is applied to said scan line of the (n−a)th column.

7. A device according to claim 3, wherein said conduction control elements comprise means for discharging the voltage held by said voltage holding means of the nth column when the scan voltage is applied to said scan line of the (n−a)th column.

8. A device according to claim 3, wherein said conduction control elements comprise means for disconnecting the connections between said organic EL elements of the nth column and said power supply electrodes when the scan voltage is applied to said scan line of the (n−a)th column.

9. A device according to claim 4, wherein said conduction control elements comprise means for conducting, as a reverse voltage to said organic EL elements of the nth column, the scan voltage that is applied to said scan line of the (n−a)th column.

10. A device according to claim 6, wherein said conduction control elements comprise means for discharging the voltage held by said voltage holding means of the nth column when a scan voltage is applied to scan line of the (n−b)th column, and conducting, as a reverse voltage to said organic EL elements of the nth column, the scan voltage that is applied to said scan line of the (n−a)th column.

11. A device according to claim 6, wherein said conduction control elements comprise means for disconnecting the connection between said organic EL elements of the nth column and said power supply electrodes when a scan voltage is applied to said scan line of the (n−b)th column and conducting, as the reverse voltage to said organic EL elements of the nth column, the scan voltage that is applied to said scan line of the (n−a)th column.

12. A device according to claim 3, wherein said a is equal to 1; and said conduction control elements comprise means for controlling conduction to said organic EL elements of the first column when the scan voltage is applied to said scan line of the Nth column.

13. A device according to claim 3, wherein said a is equal to 1; and further comprising a dummy line parallel to said scan lines of the first column and to which a dummy scan voltage is applied immediately before the scan voltage of the first column; and wherein said conduction control elements comprise means for controlling conduction to said organic EL elements of the first column when scan voltage is applied to said dummy line.

14. A device according to claim 6, wherein said a is equal to 1;

said b is equal to 2; and wherein said conduction control elements comprise means for halting the application of drive voltage to said organic EL elements of the first column when scan voltage is applied to said scan line of the (N−1)th column, and both applying a reverse voltage to said organic EL elements of the first column and halting the application of drive voltage to said organic EL elements of the second column when scan voltage is applied to said scan line of the Nth column.

15. A device according to claim 6, wherein said a is equal to 1;

said b is equal to 2;

further comprising first and second dummy lines parallel to said scan line of the first column and to which dummy scan voltage is applied in order immediately before the scan voltage of the first column; and wherein said conduction control elements comprise means for halting the application of drive voltage to said organic EL elements of the first column when scan voltage is applied to said first dummy line, and both applying a reverse voltage to said organic EL elements of the first column and halting the application of drive voltage to said organic EL elements of the second column when scan voltage is applied to said second dummy line.

16. The device of claim 1, wherein said conduction control elements comprise a switch with a control gate connected to a scan line of an (n−a)th column, where a is equal to a natural number that is less than N.

17. The device of claim 2, wherein said conduction control elements comprise a switch with a control gate connected to a scan line of an (n−a)th column, where a is equal to a natural number that is less than N.

* * * * *